United States Patent [19]

Jorgensen et al.

[11] 3,993,199

[45] Nov. 23, 1976

[54] FILLER-FITTING ALIGNMENT APPARATUS

[75] Inventors: Henry A. Jorgensen, Freeport; Robert H. Reeves, Jr., Lake Jackson; Harry Louis Kennedy; Prakash Kesaree, both of Freeport, all of Tex.

[73] Assignee: Velasco Scale Company, Inc., Freeport, Tex.

[22] Filed: May 5, 1975

[21] Appl. No.: 574,415

[52] U.S. Cl. ..... 214/1 R; 198/379

[51] Int. Cl.[2] ..... B65J 3/00

[58] Field of Search ..... 141/312, 165, 113, 171, 141/181, 283, 155; 198/33 R, 33, 257; 214/1 R, 340

[56] References Cited

UNITED STATES PATENTS 3,610,398 10/1971 Rice ..... 141/171

*Primary Examiner*—Houston S. Bell, Jr.

*Attorney, Agent, or Firm*—Arnold, White & Durkee

[57] ABSTRACT

A fluid container filler-fitting alignment apparatus for detecting and aligning the filler-fitting of the container with respect to a known location of a fill valve. There is provided an automated, pivotally mounted filler-fitting alignment apparatus for contacting the top of a fluid container, accurately locating the filler-fitting of the container and positioning the container with the fitting in a predetermined position when moving the container to a fill station for inserting a fill valve and filling the container with a fluid.

8 Claims, 9 Drawing Figures

FIG. 3
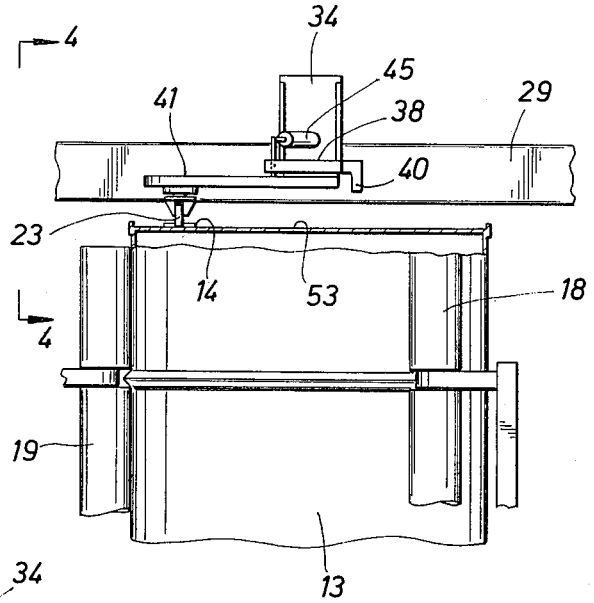
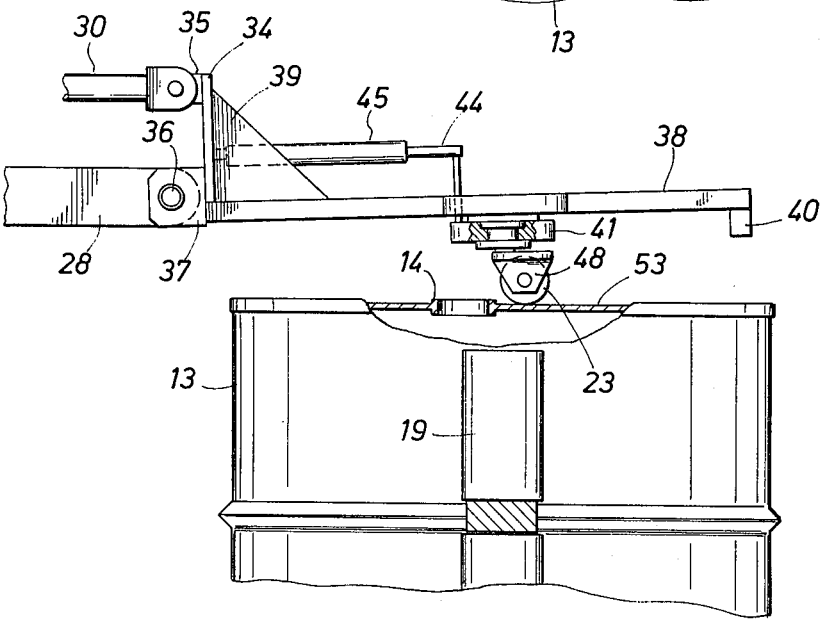
FIG. 4
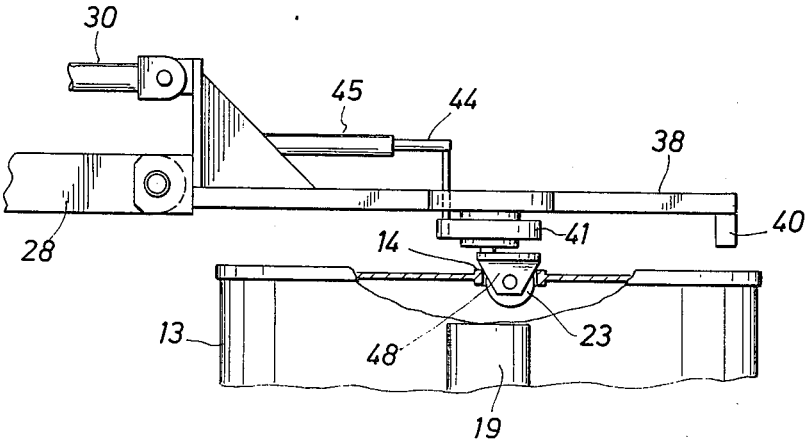
FIG. 5

FIG. 6
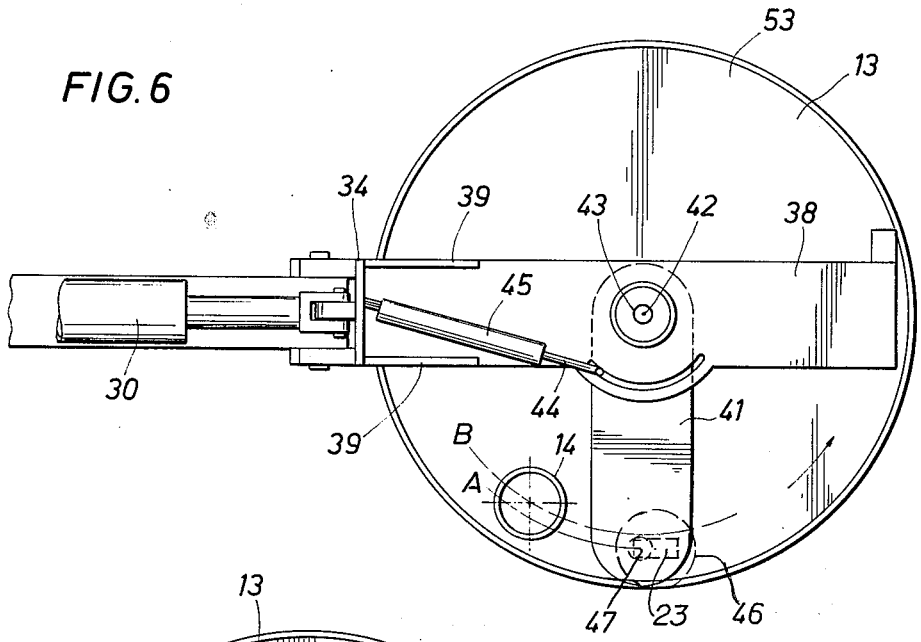
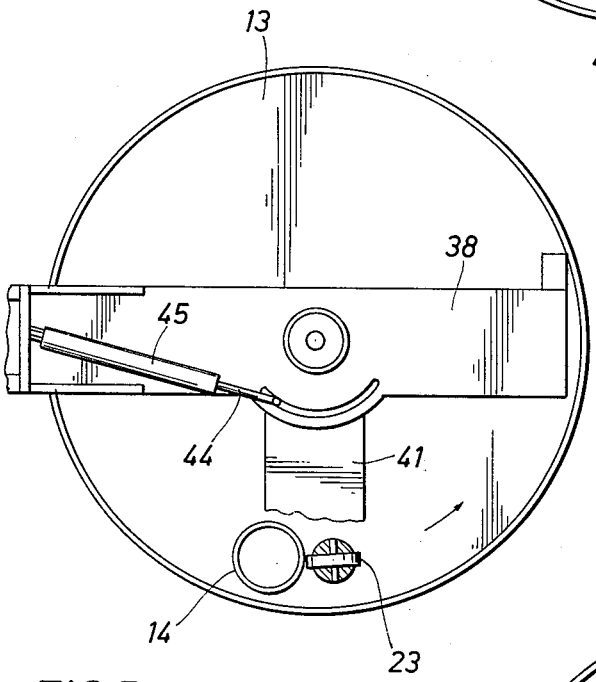
FIG. 7
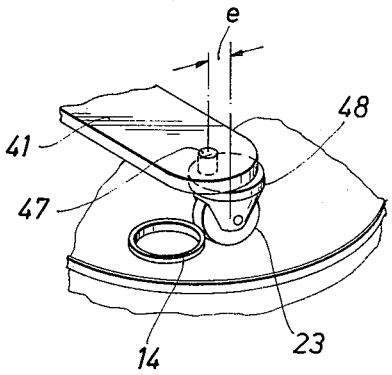
FIG. 6A
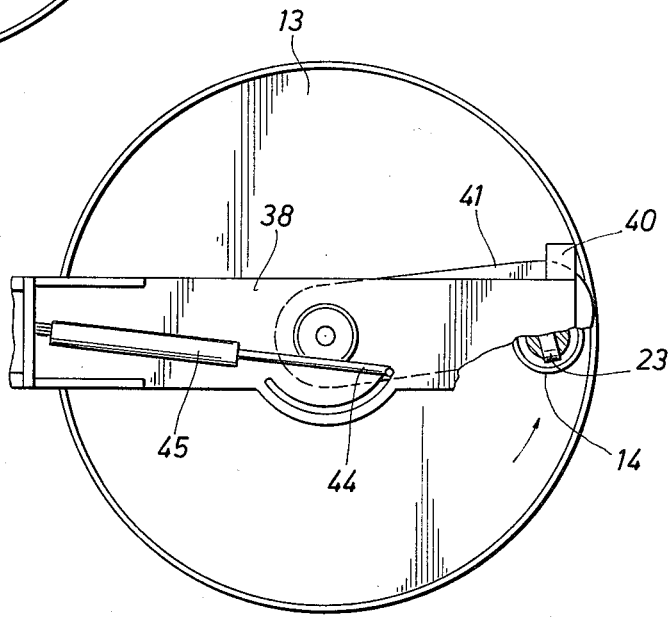
FIG. 8

FILLER-FITTING ALIGNMENT APPARATUS

BACKGROUND OF THE INVENTION

This invention relates generally to a novel apparatus for use in conjunction with the automated filling of a drum or fluid container with liquids which may be highly corrosive.

In the past, it has been common to employ electronically controlled apparatus for the filling of drums with the aformentioned fluids. The drum is manually positioned beneath a fill valve, with the fill valve, which may be of the subsurface filling type, being then manually or automatically lowered into the drum through the filler-fitting or bung for filling the drum with a fluid. Heretofore, the available filler-fitting alignment apparatus has not been accurate enough to consistently position the filler-fitting directly in alignment with the fill valve so as to not require manual positioning of the filler-fitting or the fill valve prior to insertion of the fill valve into the drum. The accuracy of the location of the filler-fitting can be appreciated by comparing the size of fitting available with the size of fill valve commonly used. In one application, the opening of the fitting measures two inches in diameter, while the fill valve, which must fit through the opening, measures 1¾ths inches in diameter. Thus, there is a tolerance of only ⅛th inch around the circumference of the outer surface of the fill valve between that surface and the inner surface of the filler-fitting. One can readily appreciate that misalignment of the fill valve will require the operator controlling the filling operation to stop the automated sequence, approach the area of the fill operation, manually adjust the position of the drum, and restart the filling sequence. This problem is amplified when highly corrosive fluids are being packaged, with a great increase in hazard to the operator as the fill station is approached.

Further, the apparatus is useful in filling a drum with any fluid or granulated material in that the necessity of having an operator locate the filler-fitting of a drum, commonly referred to in the industry as a bung, is eliminated. Thus, the containerization of fluids or granulated materials can be completely automated, removing the operator from the vicinity of the filling operation, which, of course, increases the safety associated with the filling of the drums and renders the operation less labor intensive.

SUMMARY OF THE PREFERRED EMBODIMENT OF THE INVENTION

It is, therefore, a general feature of the present invention to provide a novel drum filler-fitting alignment apparatus which minimizes or reduces the problems of the type previously noted.

It is a more particular feature of the present invention to provide an automated filler-fitting alignment apparatus for locating and positioning the filler-fitting of a fluid container, such as a 55-gallon drum, by providing an alignment apparatus for sensing, locating and positioning the drum filler-fitting with respect to a predetermined position.

It is yet a further feature of this invention to provide a filler neck fitting alignment apparatus having a drive roller for engaging the vertical surface of a fluid container substantially along the entire vertical dimension.

It is yet another feature of this invention to provide an automated filler neck fitting alignment apparatus wherein the drive roller for rotating the fluid container is adapted to fit about a ridge customarily extending around the circumference of the container.

THE DRAWINGS

A drum filler neck fitting alignment apparatus for aligning the filler-fitting of a fluid container, constructed in accordance with the preferred embodiment of the invention is illustrated in the accompanying drawings in which:

FIG. 3 is a side elevational view of a portion of the drum and drum neck filler-fitting alignment apparatus, showing the rotation of the drum as the drum filler-fitting approaches the locator cone.

FIG. 4 is a view of the alignment apparatus of FIG. 3, taken along lines 4—4 of FIG. 3.

FIG. 5 is a side elevational view of the drum filler-fitting alignment apparatus after contact with and engagement into the filler-fitting has occurred.

FIG. 6 is a top plan view of the alignment apparatus as the filler-fitting approaches the guide roller associated with the locator cone.

FIG. 6A is a perspective view of the guide wheel associated with the filler-fitting alignment apparatus as it contacts a filler-fitting which filler-fitting has its center displaced from the arc circumscribed by the natural roll of the guide roller.

FIG. 7 is a top view of the filler-fitting alignment apparatus as the guide roller contacts the filler-fitting, when the center of the filler-fitting is aligned with the arc circumscribed by the natural path of the guide roller.

FIG. 8 is a top view of the drum filler-fitting alignment apparatus as the drum ceases its rotation with the filler-fitting aligned for engagement with the fill valve.

DETAILED DESCRIPTION OF A PREFERRED EMBODIMENT OF THE INVENTION

Figure 1:
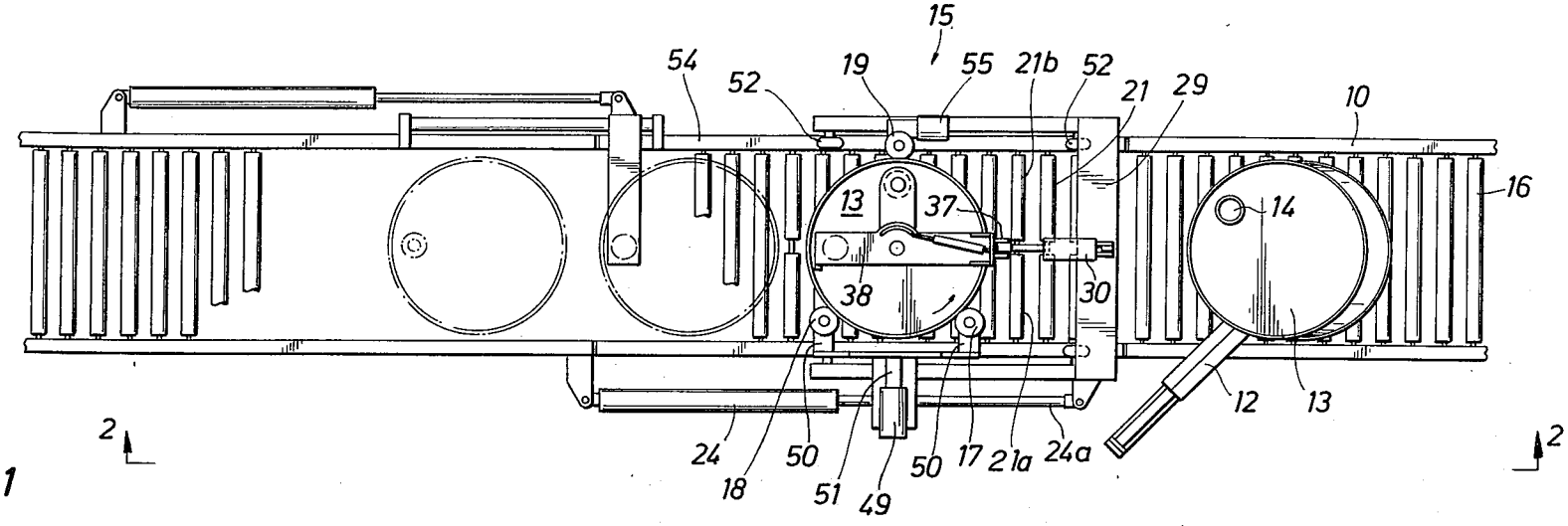
FIG. 1 is a top plan view of the filler-fitting alignment apparatus illustrated in conjunction with a conveyor for moving the fluid container from one station to another.

Referring to FIG. 1, a typical conveyor 10 with drums traveling thereon is illustrated. The conveyor may have an inclined section, such as that illustrated at 11 in FIG. 2 which directs the drums to a position adjacent the drum alignment apparatus. At this location a mechanical stop such as extensible arm 12 may be employed to stop the movement of drum 13 prior to the drum being moved into position for engagement by the filler-fitting alignment apparatus. An electrical signal may be employed to cause extensible arm 12 to retract from its extended configuration, thereby permitting drum 13 to pass by gravity or other means to the filler-fitting alignment apparatus station, indicated generally at 15. An alternative means of imparting a motive force to drum 13 in order to move it to filler-fitting alignment station 15 would be to utilize a conveyor system having powered rollers 16 which are started or stopped in response to the requirement to move drum 13 to station 15.

After being moved to alignment station 15, drum 13 is engaged by rollers 17, 18 and 19. One of said rollers may be powered in order to rotate the drum about its central axis. The portion of the conveyor in the vicinity of the filler-fitting alignment station 15 is preferably comprised of split rollers 21 which facilitate rotational motion of drum 13. Split rollers 21 are merely divided at the central location of the longitudinal axis of said rollers and, when drum 13 is driven in rotational motion by roller 19, will rotate in opposite directions. That is, as drum 13 is rotated in a counterclockwise motion as viewed in FIG. 1, roller 21*a* rotates in a clockwise direction (as viewed from the vantage point of FIG. 2) while roller 21*b* rotates in a counterclockwise direction. Alternatively, the rollers may be powered to impart rotational motion to the drum with rollers 17, 18 and 19 being idler rollers to stabilize the drum.

As drum 13 is brought into the area of filler-fitting alignment station 15, filler-fitting alignment apparatus 22, being disposed above the drum 13, is lowered pivotally about pivot point 36 such that guide roller 23 contacts the upper surface of drum 13. Contact between guide roller 23 and the upper surface of drum 13 is sensed by a limit switch actuated by the main arm 38 reaching a predetermined pivotal location. The limit switch being actuated causes powered roller 19 to initiate rotational movement of the drum. The filler-fitting of drum 13 is located by guide rollers 23, which guide roller drops into the open filler-fitting, thereby permitting further pivotal movement of main arm 38 about its pivot point. This additional movement of the main arm 38 actuates another limit switch which deenergizes powered roller 19 and drum 13 ceases rotation. Rod 24*a* of cylinder 24 then retracts thereby moving the entire filler-fitting alignment apparatus with the drum and its supporting assembly 25 to a position such that the filler-fitting center (located by the guide roller 23) is positioned exactly below a predetermined location which coincides with the fill valve 26. At this point main arm 38 of the filler-fitting alignment apparatus is pivoted upwards and away from drum 13, and the alignment apparatus is moved back into position for receiving the next drum. It is noted that after the alignment apparatus locates and positions the filler-fitting, the filler-fitting 14 is maintained in positive contact with the alignment apparatus 22 through guide roller 23 and locator cone 48 until at rest and in alignment with fill valve 26. Thus, there is no opportunity for filler-fitting 14 to be mis-positioned with respect to fill valve 26 as drum 13 is moved from station 15 to a position beneath fill valve 26.

Figure 2:
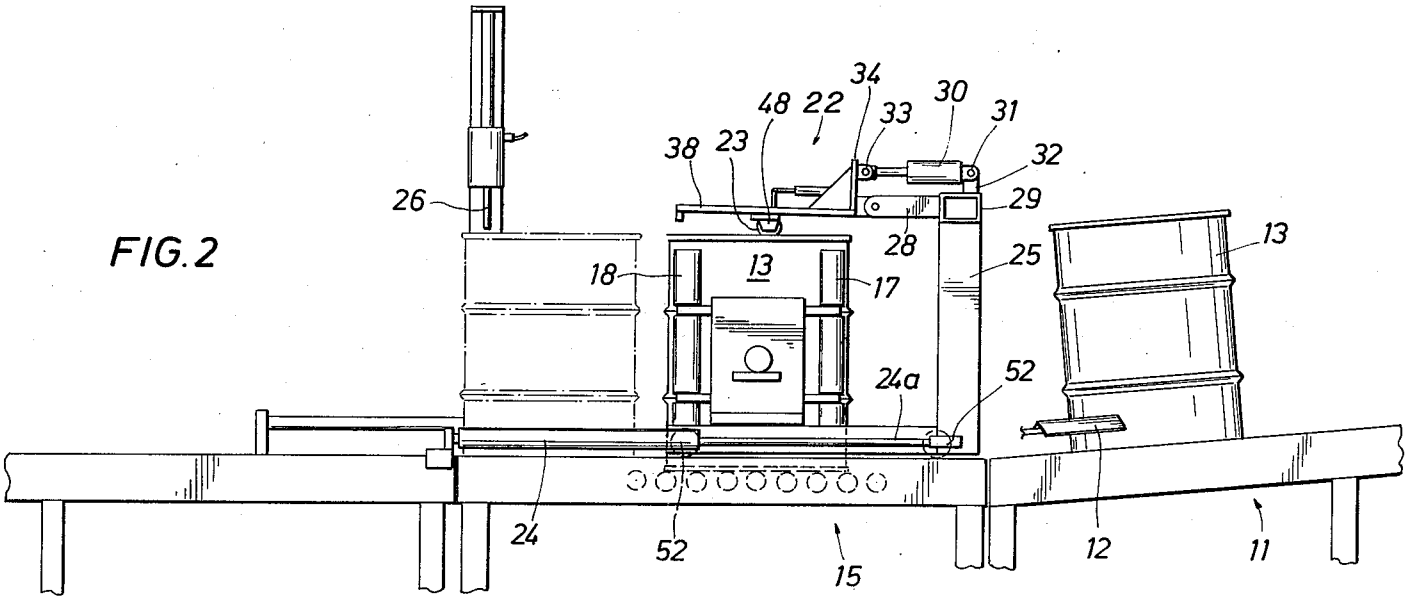
FIG. 2 is an elevational view of the filler-fitting alignment apparatus and conveyor illustrated in FIG. 1.

Now referring to FIG. 4, the details of the filler-fitting alignment apparatus will be further illustrated. Support arm 38 provides the principal support for the filler-fitting alignment apparatus as it is positioned above drum 13. Referring briefly to FIG. 2, support arm 28 is adapted to be supported by an overhead supporting assembly 25, which assembly is formed of two upstanding members adjacent the exterior sides of conveyor 10, and a cross member 29 (FIG. 1) for maintaining the upstanding members in vertical alignment, cross member 29 being spaced a sufficient distance above conveyor 10 to permit drum 13 to pass thereunder. Power cylinder 30, which may be an air operated cylinder such as one manufactured by Allen Air Corp. and designated Type No. C 2-178 × 1, is pivotally attached to cross member 29 at pivot point 31, there being a vertically extending member 32 provided for spacing pivot point 31 from cross member 29. Now turning again to FIG. 4, power cylinder 30 is pivotally connected to flange 35 of transversely extending frame 34. Frame 34, in turn, is pivotally mounted to support arm 28 by pin 36 which mounting is the principal support for the weight of the apparatus attached to frame 34. Attached to frame 34 may be ears 37, only one of which is shown in FIG. 4, for providing an extension of frame 34 to which support arm 28 is mounted. Attached and extending in perpendicular relation to the lower portion of frame 34 is main arm 38. For providing an additional extension and support between frame 34 and main arm 38, there are provided two gussets 39, which may be joined along their vertical side to frame 34 and along the horizontal or lower side to arm 38 by welding, and which provide additional strength for the weight of the apparatus affixed to main arm 38. At the end of main arm 38 opposite its pivotal connection 36, there is affixed bracket 40, to which a limit switch may be mounted. The function of this limit switch will be explained in detail hereinafter.

Turning now to FIG. 6, there is shown a plan view of main arm 38, having swing arm 41 attached thereto by pivotal mounting 42. Pivot 42 is preferably located closely adjacent the center of rotation of the circular top surface of drum 13. Swing arm 41, which may be fashioned of, for example, ½ inch thick steel, is rotatably mounted to main arm 38 about shaft 43. Attached to swing arm 41 is rod 44 of actuating cylinder 45. Rod 44 is affixed to swing arm 41 through, for example, a pivot pin fitting which facilitates movement of swing arm 41 while maintaining the connection between the rod 44 and swing arm 41. The end of actuating cylinder 45 opposite swing arm 41 is attached to frame 34 through, for example, a flexible fitting allowing movement of cylinder 45 with respect to frame 34.

Affixed to the end of swing arm 41 opposite pivot point 42 is locator cone 48. Locator cone 48 is rotatably mounted to swing arm 41 about pivot pin 47. Referring to FIG. 6A, it is noted locator cone 48 is eccentrically mounted with respect to the center of swing arm 41 as shown by the dimensional offset *e* in FIG. 6A. Locator cone 48 is free to rotate 360° about pivot pin 47. Guide wheel 23 is attached to eccentric locator cone 48. Cone 48 is conical or tapered in shape, the lowermost dimension of the cone being sufficient to accommodate the width of guide roller 23. Guide roller 23 is attached to locator cone 48 through any convenient rolling axis, and as shown, for example, through a pin which serves as the axis of rotation of wheel 23 as it rolls on the top surfae 53 of drum 13. Referring briefly to FIG. 5, the vertical displacement of main arm 38, swing arm 41, eccentric locator cone 48 is illustrated. One can readily see that swing arm 41 may be moved to a position directly beneath main arm 38, likewise locator cone 48 beneath swing arm 41, without interference between any of the members.

The eccentricity *e* on which locator cone 48 is pivoted is determined by the manufacturing tolerance in the location of filler-fitting 14. As will be explained hereinafter, the purpose of this eccentric mounting of locator cone 48 is to permit the locator cone 48 to move from side to side and thus locate filler-fittings which are at different distances from the center of the drum. That is, the center of the fitting may vary in position by as much as ¾ inch either side of the preferred location, and it is necessary to provide for guide wheel 23 moving from side to side that distance in order to locate and position the filler-fitting.

Referring again to FIG. 1, there is illustrated rollers 17, 18 and 19. As previously mentioned, as drum 13 arrives at the proper location for engagement with the filler-fitting alignment apparatus, rollers 18 and 17 are spaced adjacent to and outside of the rollers 21 of conveyor 10. An electrical signal, for example, furnished by a limit switch sensing arrival of drum 13 at the proper location, actuates power cylinder 49 which, being connected to rollers 18 and 19 through brackets 50, extends the plunger 51 to bring rollers 17 and 18 into contact with drum 13. The drum is then positioned by rollers 17, 18 and 19. Rollers 17 and 18 are further pictured in FIG. 2, where they are seen to extend over substantially the full length of drum 13. It is not uncommon to utilize drums which have been damaged, as for example, one side being caved in two inches or more, in which event, if the caved-in portion were adjacent a roller, not extending over substantially the entire height of the drum the roller would not come into contact with the side of the drum through the full 360° rotation of drum 13. Roller 19 thus contacts drum 13 substantially along its entire height in order to obviate the aforementioned problem of a narrow drive roller being out of contact with the drum adjacent a caved-in portion, thereby causing drum 13 to cease its rotation. As previously mentioned, underneath drum 13 in the position adjacent the filler-fitting alignment station, are split rollers 21*a* and 21*b*. The split rollers facilitate rotation of drum 13 about its central axis.

Further shown in FIGS. 1 and 2 are rollers 52 which provide for rolling engagement between the base of supporting assembly 25 and the edge rails 54 of conveyor 10. Supporting assembly 25 is moved parallel the longitudinal axis of conveyor 10 when moving the drum 13 from filler-fitting alignment station 15 to a position adjacent fill valve 26 by the retraction or extension of power actuator 24.

The operation of the filler-fitting alignment apparatus will be explained with reference to FIGS. 3–8. Referring to FIG. 4, the alignment apparatus is shown with guide roller 23 contacting the upper surface 53 of drum 13. Prior to drum 13 arriving at the filler-fitting alignment station, main arm 38, being pivoted about pivot point 36, is retained in a position above drum 13 by power cylinder 30 so as to not interfere with drum 13 moving along conveyor 10. As drum 13 arrives at the proper location (there may be provided a limit switch which the drum engages to initiate the following sequence) main arm 38 pivots about pivot point 36, and guide roller 23 contacts the upper surface 53 of drum 13. Simultaneously, rollers 17 and 18 are brought into contact with drum 13 by actuation of cylinder 49 and motor 55 commences operation, thereby driving roller 19. Roller 19 contacts drum 13 causing rotation of the drum about its central axis. One will note the vertical displacement between the lower edge of guide roller 23 and main arm 38 is such that main arm 38 remains at a slightly upwardly inclined angle to guide roller 23 as guide roller 23 travels along the surface of the drum. This feature is, of course, not critical but is employed merely as a convenience in providing for main arm 38 to be in a level attitude after fitting 14 is located.

Referring to FIG. 6, swing arm 41 is maintained in angular relation to main arm 38 by actuating cylinder 45. The counterclockwise rotation of drum 13 tends to urge swing arm 41, by its contact with the surface of drum 13 through eccentric arm 46, to align itself in parallel relation with main arm 38. However, swing arm 41 is maintained at its angular position with respect to main arm 38 by previously referred to actuating cylinder 45. The approach of fitting 14 to guide roller 23 is shown in FIGS. 4 and 6, at which time the guide roller and eccentric arm 46 are aligned in a trail position with guide roller 23 following the arc A circumscribed by pivot pin 47 of eccentric arm 46.

Referring to FIG. 6, as illustrated there are two arcs which will be referred to in the explanation of the operation of the filler-fitting alignment apparatus, one arc circumscribed by pivot point 47 and the other arc corresponding to the radius of the center of the opening of filler-fitting 14. These arcs will be referred to respectively as arc A, which is circumscribed by a point corresponding to the center of radial movement of pivot point 47, and arc B, corresponding to the arc circumscribed by the center of the circle describing the opening of filler-fitting 14.

As noted in FIG. 6, filler-fitting 14 of drum 13 is spaced more closely to the center of the drum than pivot point 47 about which the locator cone 48 rotates. This condition is caused by the manufacturing tolerance of locating the filler-fitting and is the principal cause of difficulty in accurately locating and positioning the drum for receiving a fill valve such as that shown in FIG. 2 at 26. Referring again to FIG. 6, the counterclockwise rotation of drum 13 causes the guide roller 23 to trail swing arm 41 and roll along arc A. At the point in the rotation of drum 13 where guide roller 23 and filler-fitting 14 first contact (as shown in FIG. 6A), the guide roller urges eccentric cone 48 to pivot about pivot point 47, thereby permitting guide roller 23 to align its rolling axis in perpendicular relation to the lip of fitting 14. With the guide wheel aligned in this manner there is less probability of it being deflected and passing around the perimeter of the fitting. It is often the case that filler-fitting 14 is upset somewhat from the surface 53 of drum 13, that is, the upper extremity of filler fitting 14 is located approximately ½ inch above the surface 53 of drum 13. This lip facilitates, although is not critical to, the operation of the filler-fitting alignment apparatus. The upset assists the guide roller 23 in its alignment in perpendicular relation to the filler-fitting as above described.

As shown in FIG. 6A, eccentric locator cone 48 will be somewhat misaligned from its natural trail position as illustrated in FIG. 6 when contacting a filler-fitting spaced from the preferred location. With guide wheel 23 being free to rotate about pivot point 47 through eccentric cone 48, the rolling axis of guide wheel 23 will be parallel to the tangent described by the point of contact between filler-fitting 14 and guide wheel 23. At this point, with the drum continuing to rotate, guide wheel 23 rolls up and over the edge of filler-fitting 14 and into the space of the filler-fitting. Recalling from FIG. 4, there is a provision for main arm 38 to pivot about pin 36, as occurs when guide wheel 23 drops into fitting 14. The locator cone 48 is sized, with respect to the diameter of the opening in fitting 14, to permit the cone to extend only partially into the opening. That is, the cone only permits arm 38 to pivot to the position indicated in FIG. 5, with cone 48 extending only a part of its vertical dimension into the opening of fitting 14. It is necessary to ascertain whether the cone 48 is on the drum top or has dropped in the opening and this may be accomplished in any conventional manner. For example, a limit switch could be employed to sense the pivotal motion of arm 38 about pin 36 or the further extension of cylinder 30 could be used to provide the feedback signal. In either event, the motion of arm 38 responsive to guide roller 23 dropping into fitting 14, through the appropriate electrical or mechanical feedback switch, deactuates cylinder 45 permitting swing arm 41 to follow the motion of the drum in a counterclockwise direction. Referring to FIG. 8, after rod 44 of cylinder 45 is released, arm 41 pivots to a point approximately parallel main arm 38. As swing arm 41 reaches the position indicated in FIG. 8, a limit switch (which may be affixed to bracket 40 of main arm 38) is actuated by the upper portion of the cone, thereby causing motor 55 (FIG. 1) to be deenergized, and drum 13 to cease its rotation. At this point, the precise location of the filler-fitting 14 is known with respect to the locator cone 48. Completing the sequence of filling the drum with a fluid, cylinder 24 is next actuated, thereby drawing support apparatus 25 toward the fill valve 26. Again, a suitable microswitch, for example, fitted on the structure contacting the cone is utilized to stop the travel of drum 13 along conveyor 10 in its proper relation to fill valve 26. At this point, the sequence associated with automatically locating and positioning the drum for filling is completed. Of course, it would be a relatively simple matter to automate the fill valve 26 to provide for its extending into the filler-fitting for filling the drum with the desired fluid. The step in the sequence associated with aligning the filler-fitting 14 of the next drum is to provide for extending the rod 24a of cylinder 24 thereby returning the alignment apparatus 22 to filler fitting alignment station 15 for receiving the next drum.

In describing the invention, reference has been made to a preferred embodiment. However, those skilled in the art and familiar with the disclosure of the invention may recognize additions, deletions, substitutions or other modifications which would fall within the scope of the invention as defined in the claims.

We claim:

1. An automated filler-fitting alignment apparatus for locating and positioning a filler-fitting of a fluid container, comprising:

a main arm pivotally mounted on a support structure adjacent a container receiving station; and a swing arm affixed at a first end to said main arm, said swing arm having, an eccentric locator cone rotatably mounted on said swing arm at a point spaced apart from the first end of said swing arm, and said eccentric locator cone having a roller mount at the lower end of said cone, said roller mount having a guide roller mounted thereto said guide roller for locating a filler-fitting in the upper surface of said fluid container.

2. The apparatus according to claim 1, further including a drive roller for imparting rotative motion to said drum.

3. The apparatus according to claim 2, wherein said drive roller is of sufficient length for engaging said fluid container substantially along its vertical dimension.

4. The apparatus according to claim 3, wherein said drive roller is adapted to fit about a ridge extending around the circumference of said fluid container.

5. The apparatus according to claim 1, wherein said main arm is pivotally lowered onto and raised away from the upper surface of said fluid container by a fluid powered actuating cylinder.

6. The apparatus according to claim 1, further including a second fluid powered actuating cylinder for maintaining said main arm and said swing arm in nonparallel alignment.

7. The apparatus according to claim 1, further including powered split rollers beneath said drum at a drum filler-fitting alignment station for imparting rotational motion to said drum.

8. An automated filler-fitting alignment apparatus for locating and positioning a filler-fitting of a fluid container, comprising:

a main arm pivotally mounted on a support structure adjacent a container receiving station; and a swing arm affixed at a first end thereof to said main arm, said swing arm having, an eccentric locator cone rotatably mounted on said swing arm at a point spaced apart from the first end of said swing arm, and said eccentric locator cone having a roller mount at the lower end of said cone, said roller mount having a guide roller mounted thereon, said guide roller being disposable so that pivotal movement of said main arm contacts said guide roller with an upper surface of a fluid container having a filler-fitting thereon, said guide roller movable relative to an upper surface of a fluid container to thereby locate a filler fitting thereon.

* * * * *